US005443569A

United States Patent [19]

Uehira et al.

[11] Patent Number: 5,443,569

[45] Date of Patent: Aug. 22, 1995

[54] FOAM DISPENSING PUMP CONTAINER

[75] Inventors: Shoji Uehira, Joyo; Masako Matsura, Ibaraki, both of Japan

[73] Assignee: Daiwa Can Company, Tokyo, Japan

[21] Appl. No.: 205,172

[22] Filed: Mar. 3, 1994

[30] Foreign Application Priority Data

Mar. 5, 1993 [JP] Japan ..... 5-014585 U

[51] Int. Cl.[6] ..... B05B 7/00

[52] U.S. Cl. ..... 222/190; 222/384; 222/321.9; 417/550

[58] Field of Search ..... 222/190, 321, 384, 385; 239/333, 432; 137/512.4; 417/550, 553

[56] References Cited

U.S. PATENT DOCUMENTS

| | | | |
|---|---|---|---|
| 3,527,242 | 9/1970 | Ansite | 137/512.14 X |
| 3,709,437 | 1/1973 | Wright | 222/190 X |
| 5,071,379 | 12/1991 | Poizot | 222/464 |
| 5,147,087 | 9/1992 | Fuchs | 239/333 |
| 5,176,296 | 1/1993 | Lina et al. | 222/385 X |
| 5,326,000 | 7/1994 | Fuchs | 222/321 |

FOREIGN PATENT DOCUMENTS

| | | |
|---|---|---|
| 0565713 | 10/1993 | European Pat. Off. . |
| 48-44121 | 12/1973 | Japan . |
| 58-2459 | 1/1983 | Japan . |
| 58-20258 | 2/1983 | Japan . |
| 60-40990 | 9/1985 | Japan . |
| 3-7963 | 1/1991 | Japan . |
| 4-293568 | 10/1992 | Japan . |
| WO92/08657 | 5/1992 | WIPO . |

*Primary Examiner*—Andres Kashnikow
*Assistant Examiner*—Lisa Douglas
*Attorney, Agent, or Firm*—Oblon, Spivak, McClelland, Maier & Neustadt

[57] ABSTRACT

A foam dispensing pump container, for dispensing foam by mixing air pumped from an air cylinder by an air piston having suction holes in its upper wall and a foamable liquid pumped from a liquid cylinder by a liquid piston having an annular projection on its outer wall, provided with an elastic valve member including a cylindrical wall portion, an outer thin annular valve portion extending outwardly from the cylindrical wall portion, and an inner thin annular valve portion extending inwardly from the cylindrical wall portion. The elastic valve member is arranged such that the cylindrical wall portion is in contact at least partially with an inner surface of the upper wall between the suction holes and an air passage, the outer thin annular valve portion is in contact, at its outer annular rim portion, with an inner surface of the upper wall extending outwardly beyond the suction holes, and the inner thin annular valve portion is in contact, at its inner annular rim portion, with the annular projection of the liquid piston below the air passage.

15 Claims, 6 Drawing Sheets

FOAM DISPENSING PUMP CONTAINER

BACKGROUND OF THE INVENTION

1. Field of the Invention

The present invention relates to a foam dispensing pump container for foaming a foamable liquid product such as shampoo, hand soap, cleaning solutions, hair-care product or shaving cream by depressing a nozzle member fixed to an upper end of a piston member of the container and pumping the foamable liquid with air into a mixing chamber, mixing the foamable liquid with the air in the mixing chamber, and homogenizing the foam through a porous member such as a net member and dispensing the homogenized foam from the nozzle member to the outside of the container.

2. Description of the related Art

The applicant has proposed several foam dispensing pump containers of the aformentioned type as disclosed in International patent application publication No. WO 92/08657 and Japanese patent application laid-open publication No. 293568/1992.

In these publications there is disclosed a foam dispensing pump container comprising: a double cylinder which is provided inside an opening portion of a container containing a liquid and which is constituted by an air cylinder and a liquid cylinder, both being arranged concentrically; a dip tube extending from a bottom portion of the liquid cylinder to a bottom portion of the container; a piston body constituted by air and liquid pistons, both pistons being arranged concentrically and integrally to move up and down in the air and liquid cylinders respectively; a hollow bent nozzle member provided at an upper end of the piston body and having nose portion, a stem and a foam passage; and air passage formed in an upper gap between the liquid piston and the air piston for allowing the foam path and an interior of the air cylinder to communicate with each other; a liquid passage formed in the liquid piston for allowing the foam passage and an interior of the liquid cylinder to communicate with each other; a second check valve disposed in an upper end of the liquid passage; a first check valve disposed at the lower end of the liquid cylinder; sheet-shaped porous members disposed in a mixing chamber communicating with the air passage and the liquid passage and in the foam passage downstream of the mixing chamber; an urging spring for urging the piston body upwardly to a top dead position with respect to the double cylinder; an air hole formed in the air cylinder to introduce an outer air outside the container into the container; and a lid member for fixing the double cylinder to the container and guiding insertion of the piston body therethrough, a suction hole provided in an upper wall portion of the air piston for introducing the outer air into an air chamber, defined by the air cylinder and the air piston, through an insertion gap between an outer circumferential surface of the air piston and an insertion hole of the lid member; a third check valve with a valve member provided in an upper wall portion of the air cylinder for opening and closing the suction hole.

The embodiment of the aforementioned foam dispensing container disclosed in the above publication bulletins uses a ball valve as the third check valve and its ball is so mounted, in the lower portion of the suction hole formed in the upper wall portion of the air piston, that it can move up and down by a predetermined amount between a valve seat on the lower surface of the circumferential edge portion of the suction hole and a projection for preventing the ball from coming off. As a result, unless the air chamber is pressurized, the ball stays seated on the projection by its own gravity, leaving the suction hole open for introducing the outer air into the air chamber, so that the outer air is promptly introduced without substantial resistance. When the interior of the air chamber is pressurized, on the other hand, the ball is urged upwardly to come into close contact with the valve seat and close the suction hole. As the air passage and the air chamber are always in communication with each other, the pressurized air in the air chamber is smoothly introduced into the mixing chamber through the air passage.

However, our subsequent investigations have revealed that the foam dispensing pump container thus constructed has the following disadvantages.

In case the nozzle member, or the pistons are depressed very slowly in foam dispensing operation, pressure in the air chamber may not rise high enough to urge the ball of the third check valve against its own gravity and force the ball to come into close contact with the valve seat. As a result, the air in the air chamber is released through the suction hole, so that no air can be fed to the mixing chamber by the time the nozzle member (or the piston member) bottoms out in its downward movement.

As the nozzle member (or the piston member) goes down, on the other hand, the foamable liquid in the liquid chamber, defined by the liquid cylinder and the liquid piston, is pumped into the mixing chamber through the liquid passage and, as no air is fed to the mixing chamber, the result is that no foam is dispensed from the nozzle member. Moreover, the portion of the foamable liquid fed to an interior of the mixing chamber but not dispensed from the nozzle member may flow down through the air passage and stay in the air chamber.

If these operations are repeated, the foamable liquid may be accumulated in the air chamber to such extend that air and the foamable liquid or just the foamable liquid is pumped from the air chamber when the nozzle member is depressed at an ordinarily desirable speed. As a result, the mixing chamber receives a mixture of air and the foamable liquid or just the foamable liquid from the air chamber, and undesired wet foam or unfoamed liquid is dispensed.

Normally, as the nozzle member (or the piston body) goes up after a dispensing action, the air chamber is subjected to a negative pressure so that air is sucked through the third check valve. However, if the third check valve picks up the foamable liquid accumulated in the air chamber, as described above, movement of the ball is disturbed due to the generally viscous nature of the foamable liquid, and functions of the third check valve may be lost, i.e., the ball may not be released from the valve seat completely so that air may not be sucked adequately. On such occasion, foam or foamable liquid in the mixing chamber may be drawn through the air passage and accumulated in the air chamber which is subjected to a negative pressure, as the mixing chamber communicates with the air chamber, resulting in undesirably thick foam containing a high ratio of liquid.

SUMMARY OF THE INVENTION

A main object of the present invention is to provide a foam dispensing pump container which is still capable of dispensing desired foam when operated slowly.

Another object of the present invention is to provide a foam dispensing pump container which can be fabricated relatively easily for commercial use.

In order to achieve the above-mentioned objects, the foam dispensing pump container according to the present invention has an elastic valve member, which is disposed inside an upper wall of an air piston having at least one suction hole and which includes a cylindrical wall portion, an outer thin annular valve portion extending outwardly from the cylindrical wall portion and an inner thin annular valve portion extending inwardly from the cylindrical portion. The elastic valve member is mounted such that its cylindrical wall portion is in contact, at least in part, with an inner surface of a portion of the upper wall between the suction hole and an air passage, the outer thin annular valve portion is in contact, at its outer annular rim portion, with an inner surface of such portion of the upper wall that .extends outwardly beyond the suction hole, and the inner thin annular valve portion is in contact, at its inner annular rim portion, with an outer annular projection which is formed below the air passage and on an outer surface of a wall of a liquid piston.

The portion of the upper wall which comes in contact with the cylindrical wall portion of the elastic valve member may be a vertical wall extending vertically.

Also, the outer thin annular valve portion of the elastic valve member may be formed into an annular panel having a convexed lower surface and a concaved upper surface, and the inner thin annular valve portion may be formed into an annular panel having a convexed upper surface and a concaved lower surface.

As a piston body formed as an integral assembly of the air piston and the liquid piston is depressed and the air chamber is pressurized, the elastic valve member is subjected to a positive pressure created inside the air chamber, and accordingly, the outer thin annular valve portion is urged to keep in contact with the inner surface of the portion of the upper wall extending outwardly beyond the suction hole, and the cylindrical wall portion also is urged to remain in contact with the inner surface of the upper wall, but the inner thin annular valve portion is urged upwardly to break the contact with the annular projection of the liquid piston.

At this time, the suction hole remains closed by the outer thin annular valve portion and the cylindrical wall portion of the elastic valve member whereas the inner thin annular valve portion being urged upwardly stays away from the annular projection of the liquid piston, so that the air passage communicates with the mixing chamber and the pressurized air in the air chamber is fed through the air passage to the mixing chamber.

Since the suction hole remains closed by the outer thin annular valve portion and the cylindrical wall portion of the elastic valve member before the piston body is depressed (that is, when the air chamber is at an atmospheric pressure before it is pressurized), the pressurized air created in the air chamber even when the piston body is depressed slowly is fed through the air passage to the mixing chamber without fail. As a result, air is mixed in the mixing chamber at a predetermined air/liquid mixing ratio with the foamable liquid supplied through a liquid passage, so that desired foam of the foamable liquid is produced at all times.

As soon as the piston body is released from depressing force on its way of downward movement, the air chamber is released from its pressurized state, so the inner thin annular valve portion instantly restores its original state, i.e., it comes into contact with the annular projection of the liquid piston again. Then, the piston body starts moving up due to pressure of an urging spring so that a negative pressure is created in the air chamber. When the air chamber is subjected to a negative pressure, the elastic valve member is urged by an external pressure so that the outer annular rim portion of the outer thin annular valve portion is displaced downwardly to break the contact with the inner surface of the portion of the upper wall extending outwardly beyond the suction hole, whereas the cylindrical wall portion is held in contact with the inner surface of the upper wall.

As a result, the air passage to the air chamber closes and the suction hole opens so that air is sucked through the suction hole into the air chamber but no air in the air passage or the foam in the mixing chamber may be drawn into the air chamber.

If the inner surface of the portion of the upper wall which comes into contact with the cylindrical wall portion of the elastic valve member is formed in a vertical wall extending vertically, such inner surface may serve as a guide wall for guiding installation of the elastic valve member inside the upper wall, so that the elastic valve member can readily be aligned at assembling the pump and correct contact of the cylindrical wall portion with such inner surface, when the air chamber is subjected to a positive or negative pressure, can be ensured.

On the other hand, if the outer thin annular valve portion of the elastic valve member is formed substantially into an annular panel having a convexed lower surface and a concaved upper surface and the inner thin annular valve portion is formed substantially into an annular panel having a convexed upper surface and concaved lower surface, the elastic valve member of improved strength with least deformation may be obtained by injection molding. Moreover, the elastic valve member of the aforementioned construction may operate more effectively by air pressure for opening the suction hole and an inlet of the air passage respectively, so that greater openings are created effectively.

The above and further objects and novel features of the present invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE ACCOMPANYING DRAWINGS

DESCRIPTION OF THE PREFERRED EMBODIMENTS

Figure 1:
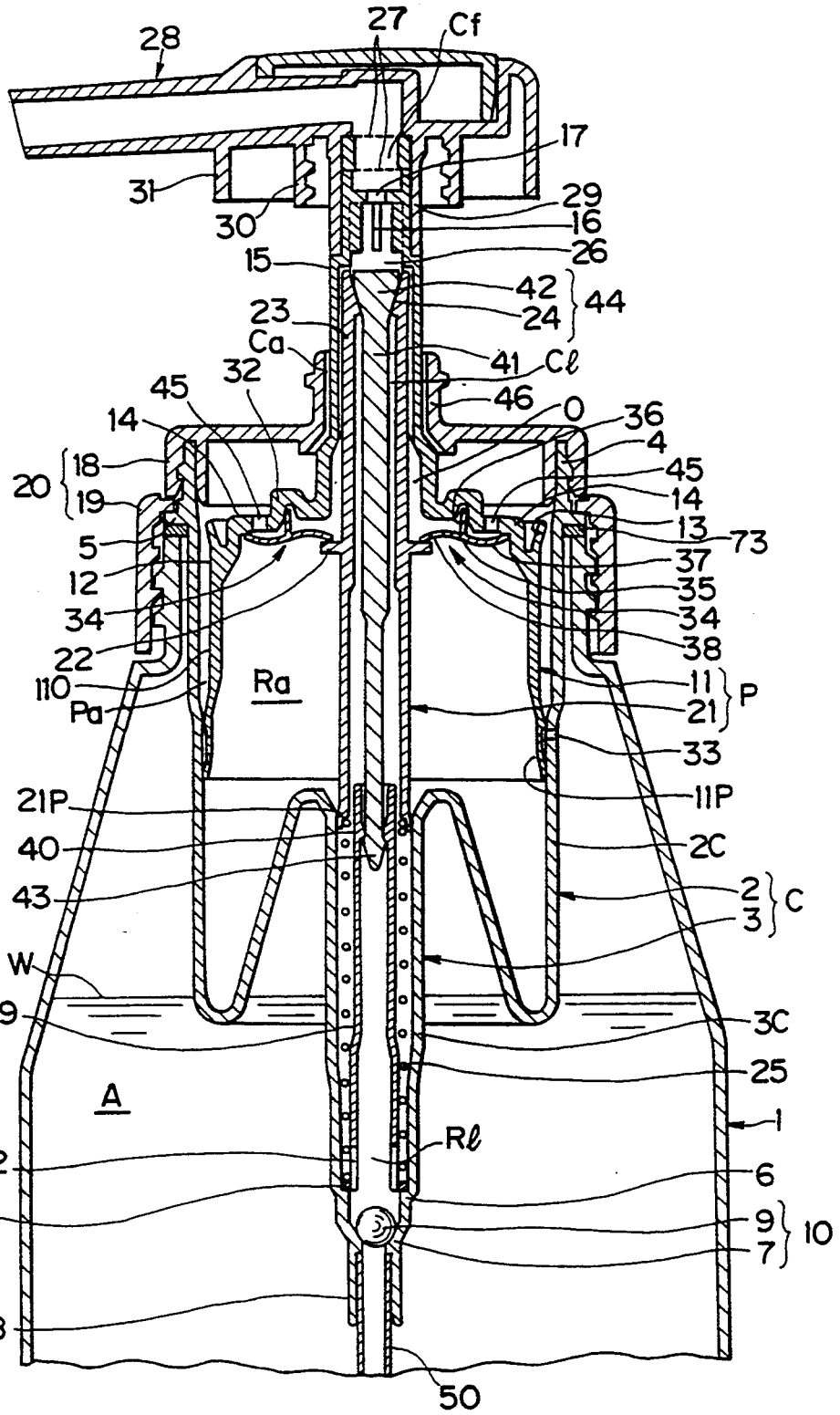
FIG. 1 is a longitudinal section showing an essential portion of a first embodiment of the present invention in which the piston body is at the top dead position of its movement.
Figure 2:
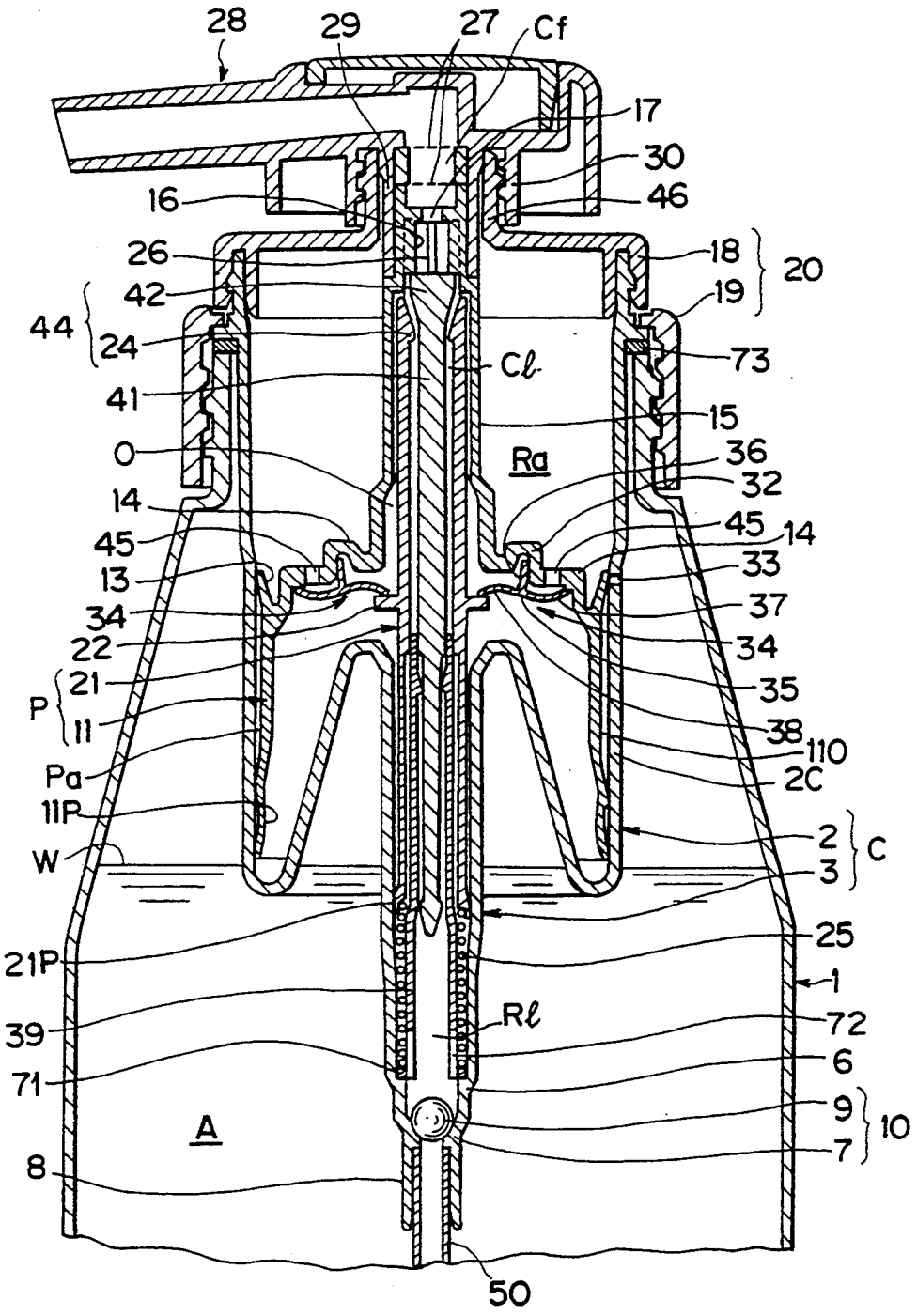
FIG. 2 is a longitudinal section showing a state of the first embodiment, in which a hollow bent nozzle member and a lid member are in engagement with each other and the piston body is at the bottom dead position of its movement.
Figure 3:
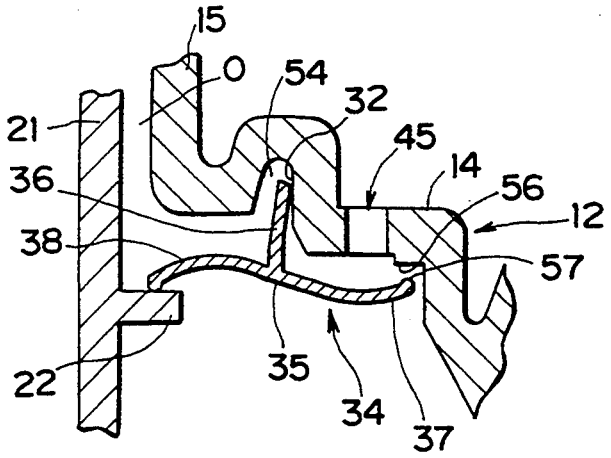
FIG. 3 is a longitudinal section showing a portion of a third check valve of the first embodiment in an enlarged scale, in which a negative pressure prevails in the air chamber.
Figure 4:
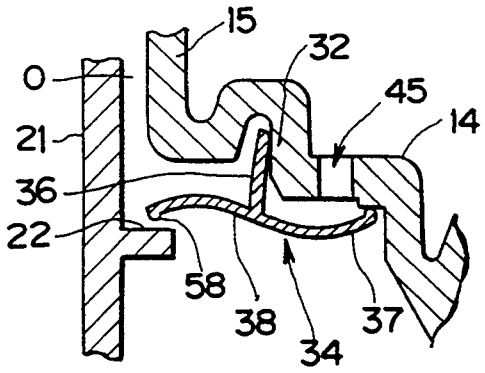
FIG. 4 is a longitudinal section showing a portion of the third check valve of the first embodiment in an enlarged scale, in which a positive pressure prevails in the air chamber.
Figure 5:
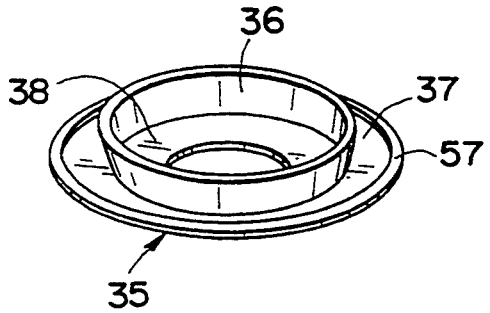
FIG. 5 is a perspective view showing an elastic valve member used in the first embodiment.

Described herein below is the first embodiment of the present invention with reference to the accompanying drawings. FIGS. 1 to 4 show longitudinal sections of essential portions of the first embodiment of the present invention: FIG. 1 shows a state in which the piston body is at its top dead position before the nozzle member is depressed; FIG. 2 shows a state in which the piston body is brought to its bottom dead position and the nozzle member and the lid member are engaged with each other; FIG. 3 shows the positional relations of the elastic valve member with an upper wall of the air piston and the outer annular projection of the liquid piston when the suction hole of the air piston is open and the inlet of the air passage is closed; and FIG. 4 shows the positional relations of the elastic valve member with the upper wall of the air piston and the outer annular projection of the liquid piston when the suction hole of the air piston is closed and the inlet of the air passage is open. FIG. 5 is a perspective view showing the elastic valve member which is used in the first embodiment.

In the drawings, a container 1 is made of a synthetic resin and contains a foamable liquid A to a liquid level W. This container 1 has external threads on an outer circumferential edge portion of its opening. A collar 19 has a large opening which is provided in its top wall and an outer circumferential portion which is threaded internally. The collar is engaged threadably and sealingly with the container 1 to firmly fasten a foam dispensing pump assembly (to be described later) to the container.

Cylinder C is a double cylinder of the foam dispensing pump assembly and formed integrally by a molded synthetic resin. This double cylinder C has, as shown, a large air cylinder 2 and a small liquid cylinder 3, which are formed concentrically with each other. An upper opening edge portion of the double cylinder C has a fitting annular portion 4 fitted in a locking arrangement into a lid member 18 and a flange portion 5 at which the double cylinder C is fastened to the container 1. The lid member 18 and the collar 19 constitute a lid means 20.

The lid member 18 has a circular opening in the center of its top wall and a cylindrical wall 46 extending upwardly from the rim of the circular opening. This cylindrical wall 46 has, at its outer surface, external threads to be engaged with internal threads of an inner surface of an inner cylindrical wall 30 of a nozzle member 28 to be discussed later.

A piston body P which comprises an air piston 11 and a liquid piston 21, both of which are made of a synthetic resin and integrally assembled in a concentric arrangement to each other. When these pistons 11 and 21 are forced into the air cylinder 2 and the liquid cylinder 3 respectively at assembly, a spring is inserted at least between either cylinder 2 or 3 and its mating piston 11 or 21 so that the pistons 11 and 21 are urged upwardly at all times by the spring. In the first embodiment, a coil spring 25 is mounted between the liquid cylinder 3 and the liquid piston 21.

The double cylinder C will be described in more detail. The air cylinder 2 comprises: a cylindrical guiding wall portion which is diametrically smaller than, and disposed below, the fitting annular portion 4; and a cylindrical slide way portion 2C formed in extension of and made smaller in its internal diameter than the cylindrical guiding wall portion; and a bottom wall portion extending diametrically inwardly from a lower end of the cylindrical slide way portion 2C and then turning upwardly at its central portion. On the other hand, the liquid cylinder 3 comprises: a cylindrical wall portion 3C of a common internal diameter extending downwardly in continuation from an upper end of the turned up portion of the bottom wall portion of the air cylinder 2; an annular seat portion 6 converging downwardly from the cylinder portion 3C to provide a seat for receiving a lower end of a later-described cylindrical retaining member 39; a funnel-shaped valve seat portion 7 extending downwardly from the seat portion 6 for providing a valve seat for a ball valve; and a cylindrical lower hole portion 8 terminating the liquid cylinder 3.

The cylindrical slide way portion 2C of the air cylinder 2 has, at its upper end portion, an air hole 33 for introducing air into the container 1.

On the valve seat portion 7 of the liquid cylinder 3, on the other hand, there is placed a stainless steel ball as a valve member 9. This ball 9, in conjunction with the valve seat portion 7, constitutes a first check valve 10 for opening an inlet of a liquid chamber Rl, which is defined by the liquid cylinder 3 and the liquid piston 21, when a negative pressure prevails in the liquid chamber.

Press-fitted to the lower hole portion 8, there is a dip tube 50 which extends to reach the bottom of the container 1.

Thus, the piston body P, serving as the piston of the foam dispensing pump assembly of the present invention, moves up and down integrally in the air cylinder 2 and the liquid cylinder 3 of the double cylinder C.

The air piston 11 is integrally molded of a synthetic resin and comprises: a cap-shaped air chamber portion 12; an annular sliding seal portion 11P of a C-shaped section extending downwardly and outwardly from the lower end of the air chamber portion 12 and moving up and down sealingly in sliding contact with inner surfaces of the cylindrical slide way portion 2C to create sufficient hermetic seal; a hollow rod portion 15 extending upwardly from a central portion of the air chamber portion 12; and an annular seal portion 13 extending upwardly and outwardly from an upper portion of the air chamber portion 12. The annular seal portion 13 stays away from inner surfaces of the cylindrical guiding way portion and closes the air hole 33 of the air cylinder 2 in conjunction with the sliding seal portion 11P only when the piston body P is lowered to its bottom dead position (as shown in FIG. 2).

The sliding seal portion 11P and the annular seal portion 13 of the air piston 11 are shaped and sized so as to close the air hole 33 of the air cylinder 2 and are disposed at such a predetermined vertical distance from one to the other that the air hole is closed just by the sliding seal portion 11P when the air piston 11 is at the top dead position, as shown in FIG. 1 and by the annular seal portion 13 and an upper seal portion of the sliding seal portion 11P having the C-shaped section when the air piston 11 is at the bottom dead position, as shown in FIG. 2. Between those seal portions 11P and 13 is an air passage forming wall portion 110.

As a result, the air hole 33 stays open while the air piston 11 is moving up or down and until it reaches either the top or bottom dead position. Since the inside of the container 1 communicates with the open air through both an air passage Pa, which is defined by the cylindrical guiding wall portion of the air cylinder 2, an outer wall of the air chamber portion 12 of the air piston 11 and the annular seal portion 13, and a gap Ca formed between an inner surface of the cylindrical wall 46 at the central portion of the lid member 18 and the outer surface of the rod portion 15 of the air piston 11 extending through cylindrical wall 46, a negative pressure created in the container as the liquid is sucked from the container 1 by the liquid piston 21 is instantly relieved by introduction of the open air from the air hole 33.

The air chamber portion 12 of the air piston 11 is provided, on its upper wall 14, with a third check valve 34 for introducing air into an air chamber Ra, which is defined by the air cylinder 2 and the air piston 11, when a negative pressure prevails in the air chamber Ra as the air piston 11 rises, and for opening an inlet of a later-described air passage O only when a positive pressure prevails in the air chamber Ra.

In the first embodiment, the third check valve 34 comprises as shown: an inner surface of the upper wall 14; two suction holes 45 formed in the upper wall 14; an annular projection 22 formed on a portion of an outside wall of the liquid piston 21 and slightly below the boundary between the upper wall portion 14 and the rod portion 15 of the air piston 11; and an elastic valve member 35 made of a soft synthetic resin and arranged in such position as to close the inlet of the later-described air passage O and the suction holes 45.

As shown more clearly in FIGS. 3 to 5, the elastic valve member 35 comprises: a cylindrical wall portion 36; an outer thin, annular valve portion 37 extending outwardly from the cylindrical wall portion 36 and having a generally convexed lower surface and a generally concaved upper surface; and an inner thin, annular valve portion 38 extending inwardly from the cylindrical wall portion 36 and having a generally convexed upper surface and a generally concaved lower surface. An upper surface of the outer annular rim portion 57 of the outer thin annular valve portion 37 and a lower surface of the inner annular rim portion 58 of the inner annular valve portion 38 are individually provided with annular projections for establishing adequate hermetic seal with corresponding valve seats.

The gap portion between an upper outer surface of the liquid piston 21 which is press-fitted in the rod portion 15 of the air piston 11 and an inner surface of the rod portion 15 forms an air passage O. A portion of the upper wall 14 between the air passage O and the suction holes 45 is provided, in its inner surface, with an annular groove 54 for accommodating the cylindrical wall portion 36 of the elastic valve member 35. A portion of the inner surface of the upper wall 14 extending outwardly beyond the suction holes 45 is provided with an annular projection 56 serving as a surface to contact the upper surface of the outer annular rim portion 57 of the outer thin annular valve portion 37 of the elastic valve member 35 (as seen from FIG. 3).

The annular projection 22 serves as a surface to contact the lower surface of the inner annular rim portion 58 of the inner thin annular valve portion 38 of the elastic valve member 35.

The elastic valve member 35 is so arranged in the air piston 11 that the cylindrical wall portion 36 may contact a surface of a vertical wall 32 of the annular groove 54, the upper surface of the outer annular rim portion 57 of the outer thin annular valve portion 37 may contact the annular projection 56 provided in the portion of the upper wall 14 extending outwardly beyond the suction holes 45, and the lower surface of the inner annular rim portion 58 of the inner thin annular valve portion 38 may contact an upper surface of the annular projection 22. Incidentally, the space between the inner thin annular valve portion 38 and the inner surface of the upper wall 14 above the inner thin annular valve portion 38 is large enough for the inner thin annular valve portion 38 to be displaced as shown in FIG. 4.

When the third check valve 34 thus constructed is not operated, the outer annular rim portion 57 of the outer thin annular valve portion 37 is in contact with the annular projection 56 on the inner surface of the upper wall 14, and the inner annular rim portion 58 of the inner thin annular valve portion 38 is in contact with the annular projection 22 of the liquid piston 21. As the air chamber Ra is pressurized, on the other hand, the inner thin annular valve portion 38 of the elastic valve member closing the inlet of the air passage O, or the passage to communicate the air chamber Ra to the air passage O, is displaced (i.e., elastically deformed) upwardly as shown in FIG. 4 to break contact with the annular projection 22, thereby opening the inlet of the air passage O. When a negative pressure is created in the air chamber Ra, on the contrary, the outer thin annular valve portion 37 of the elastic valve member 35 closing the suction holes 45 is displaced (i.e., elastically deformed) downwardly to break contact with the inner surface (i.e., the annular projection 56) of the upper wall 14 extending outwardly beyond the suction holes 45, thereby opening the suction holes 45.

The hollow rod portion 15 of the air piston 11 comprises a lower portion, in which the liquid piston 21 is press-fitted and an upper portion for forming a mixing chamber 26. An internal diameter of the lower portion is substantially equal to an external diameter of the liquid piston 21, and the lower portion has a plurality of relatively wide vertical grooves for forming the air passage O in conjunction with the outer surface of the liquid piston 21. The upper portion of the hollow rod portion 15 has an internal diameter smaller than the external diameter of the liquid piston 21 and the vertical grooves in the lower portion extend inwardly as horizontal grooves in a shoulder portion formed at a transition between the lower portion and the upper portion. The mixing chamber 26 is provided therein with a plurality of vertical ribs 16 disposed in a radial arrangement and has an opening hole portion 17 at its upper end.

Incidentally, the vertical grooves and the horizontal grooves may of course be formed in the outer wall of the liquid piston 21.

Since this liquid piston 21 is press-fitted in the rod portion 15 of the air piston 11, these two pistons move up and down integrally as the piston body P.

The liquid piston 21 has a generally hollow cylindrical shape. The liquid piston 21 is provided, on an inner surface of its upper end portion, with a valve seat 24, which is funnel-shaped to have a larger internal diameter towards its upper end portion, and, at its lower end portion, with a sliding seal portion 21P which moves up and down sealingly in the cylindrical wall portion 3C of the liquid cylinder 3. The sliding seal portion 21P has, on its inner wall, an annular portion for receiving the upper end of the coil spring 25. The inner wall of the liquid piston 21 is diametrically reduced at its intermediate portion, i.e., the upper portion of the hollow cylinder, to form a smaller-diameter portion 23.

In the liquid piston 21, as shown, there are fitted a rod valve member 41 and a cylindrical retaining member 39, both of which are molded of synthetic resins. In conjunction with the liquid piston 21, the rod valve member 41 forms a second check valve 44. This second check valve 44 opens and closes a liquid outlet at an upper end of the liquid piston 21 as the piston body P is moved up and down. Of these components, the rod valve member 41 is formed to have a larger rod portion at its upper portion and a smaller rod portion at its lower portion. At the upper end of the larger rod portion of the rod valve member 41 is a valve head portion 42 of an inverted conical shape. At a lower end of the smaller rod portion of the rod valve member 41 is a diametrically enlarged portion 43 extending from the smaller rod portion via a step and then converging towards its bottom end. The larger rod portion of the rod valve-member 41 has an external diameter smaller than the internal diameter of the smaller diameter portion 23 of the liquid piston 21 so that a liquid passage Cl is formed when the larger rod portion is inserted into the upper portion of the liquid piston 21. Further, at least the largest diameter of the cone of the valve head portion 42 at the upper end of the rod valve member is larger than the smallest diameter of the funnel-shaped valve seat 24 at the upper end portion of the liquid piston 21, so that valve actions (of the second check valve 44) for opening or closing the liquid outlet at the upper-end of the liquid piston 21 are effected by the valve portion 42 in conjunction with the funnel-shaped valve seat 24 at the upper end of the liquid piston 21.

On the other hand, the cylindrical retaining member 39 has, at its lower end portion, an outwardly extending annular receiving portion 71 to receive a lower end of the spring 25, and a slotted cylindrical wall portion extending above the receiving portion 71 and having a plurality of radially disposed vertical slots 72 providing a liquid passage Cl, and a completely cylindrical portion which is formed in extension of the slotted cylindrical wall portion and has, on its inner wall, an inwardly annular projection 40 for engaging with the diametrically enlarged portion 43 at the lower end of the rod valve member 41 so as to prevent the rod member 41 from moving up. Further, the cylindrical retaining member 39 has, at its upper end portion, an upper cylindrical sealing portion which is sealingly fitted into the space between the upper inner surface of the liquid piston 21 and the larger rod portion of the rod valve member 41 to close the liquid passage Cl when the nozzle member 28 and the lid member 18 are threadably engaged with each other as shown in FIG. 2.

Incidentally, the cylindrical retaining member 39 is supported upright in the liquid cylinder 3 (or a liquid chamber Rl) by a seat 6 formed at the lower portion of the liquid cylinder 3, and restricts upward movement of the ball 9 of the first check valve 10 by its lower end portion. Here, the liquid chamber Rl is in communication with the liquid passage Cl through the vertical slots 72 provided in the cylindrical retaining member 39.

The nozzle member 28 has an L-shaped foam passage Cf, two net members 27 disposed across the foam passage Cf, inner and outer cylindrical walls 30 and 31 which are arranged concentrically with each other at its lower portion, and a hollow cylindrical stem 29. At assembly, the upper end of the rod portion 15 of the air piston 11 is press fitted into the stem 29 of the nozzle member 28 to form an integral assembly. Incidentally, the stem 29 has an annular recess in its inner surface and the rod portion 15 has an annular ridge on an outer surface of its upper end portion so that the upper end of the rod portion 15 is locked in the stem 29 by engagement of the annular ridge with the annular recess of the stem. Of course, the ridge and the recess may be replaced with each other and other appropriate engagement means can be used to replace such locking arrangement. The respective net members 27 are made of woven synthetic threads welded to each side of a synthetic resin spacer and press-fitted to the nozzle member 28.

Figure 8:
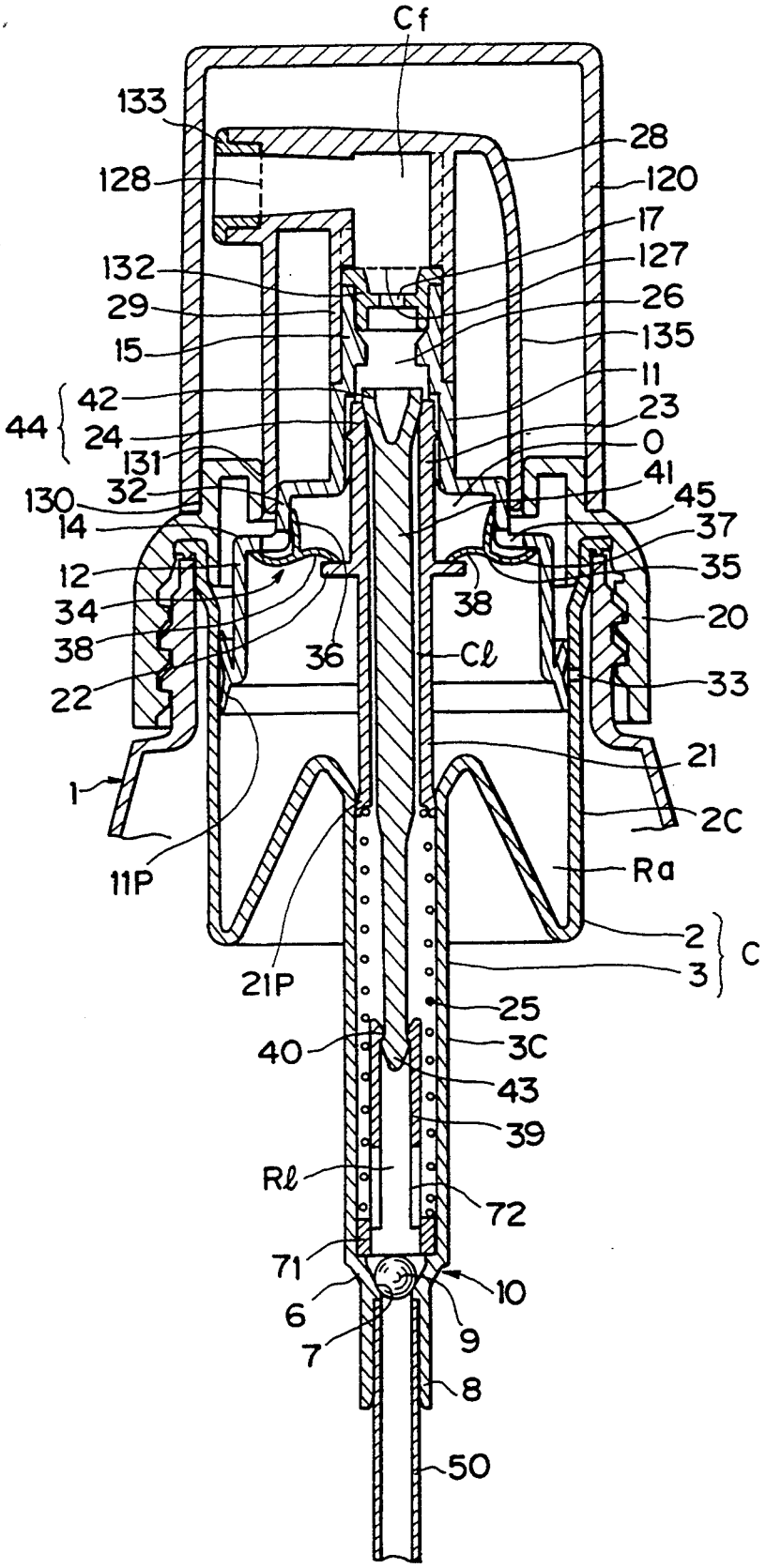
FIG. 8 is a longitudinal section showing an essential portion of a third embodiment of the present invention in which the piston body is at the top dead position of its movement.

The respective net members 27 in the present embodiment have been welded to the respective sides of the spacer, but the net member 27 at the downstream side of the foam passage may be positioned further away from the other net member 27 and installed, for example, in the vicinity of an opening at a tip of the nozzle member 28, as shown in FIG. 8. If the net member 27 at the downstream side of the foam passage is given finer (or smaller) meshes than the other net member 27, finer foam can be produced. In the present embodiment, the inner cylindrical wall 30 disposed at the lower portion of the nozzle member 28 is internally threaded for engagement with the externally threaded portion of the cylindrical wall 46 of the lid member 18.

Hereinafter described is one example of a method of assembling the foam dispensing pump container of the first embodiment.

First of all, an annular seal member 73 of a soft synthetic resin is inserted from the underside of the liquid cylinder 3 and set to the lower surface of the flange portion 5 of the double cylinder C. Then, the ball 9 of the first check valve 10 is inserted into the liquid cylinder 3. After this, the cylindrical retaining member 39 is inserted into the liquid cylinder 3, and the coil spring 25 is placed onto the retaining member 39.

While the air piston 11 is held upside-down with the rod portion 15 being directed downwards, the elastic valve member 35 is inserted therein with its cylindrical portion 36 orientated downwards, and the rod valve member 41 is then installed and its valve member portion 42 is placed in the rod portion 15. After this, the upper end of the liquid piston 21 having the valve seat 24 is forced into the rod portion 15 so that the rod valve member 41 will be accommodated in the liquid piston 21.

In this step, the air piston 11 and the liquid piston 21 are firmly fastened with each other as the internal diameter of the lower portion of the rod portion 15 of the air piston 11 is substantially equal to the external diameter of the liquid piston 21.

At this time, the cylindrical wall portion 36 of the elastic valve member 35 is accommodated in the annular groove 54 of the upper wall 14 of the air piston 11 such that its upper portion will come into contact with surfaces of the vertical wall 32 defining an outer periphery of the annular groove 54. Simultaneously the outer annular rim portion 57 of the outer thin annular valve portion 37 of the elastic valve member 35 comes into contact with the inner surfaces (i.e., the annular projection 56) of the upper wall 14 disposed outwardly beyond the suction holes 45, and the inner annular rim portion 58 of the inner thin annular valve portion 38 of the elastic member 35 comes into contact with the upper surface of the annular projection 22 of the liquid piston 21.

Then, the assembly of the air piston 11, liquid piston 21 and rod valve member 41 is inserted into and aligned with the double cylinder C preassembled with-the cylindrical retaining member 39. This insertion is so forcibly carried out that the diametrically enlarged portion 43 at the lower end of the rod valve member 41 expands the annular projection 40 of the cylindrical retaining member 39 and passes therethrough.

Next, the collar 19 and then the lid member 18 are set to the double cylinder C, such that the fitting annular wall portion 4 of the double cylinder C is firmly fastened to the lid member 18 in a locking engagement.

After this, the spacer having the net members 27 on both sides is forced and inserted from the lower end of the stem 29 of the nozzle member 28, and the upper end portion of the rod portion 15 of the air piston 11 is press-fitted to the stem 29.

Next, the nozzle member 28 is depressed to compress the coil spring 25 so as to engage the internally threaded portion of the inner cylindrical wall 30 of the nozzle member 28 with the externally threaded portion of the circumferential wall 46 of the lid member 18. Then, the dip tube 50 is press-fitted into the lower hole portion 8 of the liquid cylinder 3 to form the complete foam dispensing pump assembly fastened to the lid member 18. Finally, the pump assembly is mounted to the container filled with a predetermined amount of foamable liquid A, and fastened thereto by turning the collar 19 to fully engage its internally threaded portion with the externally threaded portion of the opening of the container 1, so that a complete foam dispensing pump container of the present invention shown in FIG. 2 is obtained.

In the assembled state of the foam dispensing pump container, as is apparent from FIG. 2, the air hole 33 of the air cylinder 2 is closed by the annular seal portion 13 of the upper portion of the air piston 11 in conjunction with the upper seal portion of the sliding seal portion 11P having the C-shaped section, and the liquid passage Cl is closed by the upper cylindrical portion of the cylindrical retaining member 39 fitted in a space between the upper smaller diameter portion 23 of the liquid piston 21 and the larger rod portion of the rod valve member 41. Thus, the container 1 remains hermetically sealed so far as the treadable engagement of the internally threaded portion of the nozzle member 28 and the externally threaded portion of the lid member 18 is maintained.

Incidentally, the annular seal portion 13 may be formed to a size and to a shape, such as with a C-shaped section, for example, so that it can directly close the air hole 33 by itself.

The assembled state of the foam dispensing pump container shown in FIG. 2 is maintained until the container is served for use by consumers, and even if the container is subjected to vibrations or laid down horizontally for a long time while it is being transported, for example, the foamable liquid A may not go into the air cylinder 2 as the air hole 33 is closed, as described above.

Furthermore, should the first check valve 10 be opened to admit the foamable liquid A into the liquid chamber Rl while the container 1 is laid in a horizontal position or should the foamable liquid A in the dip tube 50 force the ball of the first check valve 10 due to increase of an internal pressure in the container caused, for example, by an abrupt rise of an ambient temperature, and go into the liquid chamber Rl, the foamable liquid may not leak out through the mixing chamber 26 at the outlet of the liquid passage Cl or flow backwards into the air chamber Ra, as the liquid passage Cl is closed.

To operate this foam dispensing pump container, the nozzle member 28 must firstly be released from the threadable engagement with the lid member 18. Then, the piston body P, the nozzle member 28 and the rod valve member 41 are moved up to the positions shown in FIG. 1 by the function of the coil spring 25. In this position, the cylindrical retaining member 39, with its lower end receiving portion 71 being urged against the seat portion 6 of the liquid cylinder 3 by the coil spring 25, retains the rod valve member 41 at its diametrically enlarged portion 43 by means of the annular projection 40 so that the rod valve member 41 is restricted of further upward movement while the valve member portion 42 is brought into contact with the valve seat 24 to restrict further upward movement of the liquid piston 21 and govern the top dead position of movement of the piston body P.

As the air piston 11 and the liquid piston 21 are moved up, a negative pressure is created in the air chamber Ra and the liquid chamber Rl respectively so that the outer thin annular portion 57 of the elastic valve member 35 is pulled away from the inner surface of the upper wall 14 disposed outwardly of the suction holes 45 and the ball 9 is pulled off from the valve seat portion 7. As a result, air in the upper space above the upper wall of the air piston 11 is sucked into the air chamber Ra and the foamable liquid A in the dip tube 50 and the container 1 is drawn into the liquid chamber Rl.

As the foamable liquid A in the container 1 is drawn into the dip tube 50 the container 1 has a greater head space reducing an air pressure therein. However, since the air hole 33 remains open for a period of time when the piston body P in the position shown in FIG. 2 is moved to the position shown in FIG. 1 and the annular seal portion 13 and the air chamber portion 12 of the air piston 11 are spaced from the inner circumference of the cylindrical guiding wall having a larger diameter than that of the cylindrical wall portion 2C of the air cylinder 2, air in the upper portion of the air cylinder 2 is instantly sucked through the air hole 33 into the container 1 to compensate the reduced air pressure. Simultaneously, the open air outside the container 1 is drawn into the upper portion of the double cylinder C through the gap Ca between the outer surface of the rod portion 15 of the air piston 11 and the circumferential wall 46 at the central portion of the lid member 18.

When the nozzle member 28 is depressed by one's hand against repelling force of the coil spring 25, the air piston 11, which has its upper portion press-fitted in the stem 29 of the nozzle member 28, and the liquid piston 21, which has its upper portion press-fitted in the upper portion of the air piston 11 move down simultaneously. At this time, the rod valve member 41 does not move until it comes into abutment against and is forced by the lower end of vertical ribs 16 provided in the mixing chamber 26 at the upper portion of the rod portion 15 of the air piston 11, so that the valve member portion 42 of the rod valve member 41 of the second check valve 44 seated in the funnel-shaped valve seat 24 to close the liquid outlet at the upper end of the liquid piston 21 in FIG. 1 breaks contact with the valve seat 24 and the outlet of the liquid passage Cl to the mixing chamber 26 is opened.

When the air piston 11 and the liquid piston 21 are moved down, the ball 9 of the first check valve 10 is urged towards the valve seat portion 7 by pressure of the foamable liquid A in the liquid chamber Rl, so that the inlet to the liquid chamber Rl at the lower end of the liquid cylinder 3 remains closed. On the other hand, the elastic valve member 35 of the third check valve 34 is urged towards the upper wall by pressurized air so that the inner thin annular valve portion 38 is displaced upwards and the inner thin annular rim portion 58 moves away from the upper surface of the annular projection 22 of the liquid piston 21 while the respective cylindrical wall portion 36 and outer thin annular valve portion 37 is held in contact with the vertical wall 32 and the annular projection 56, respectively. As a result, the inlet of the air passage 0 is opened while the suction holes 45 are closed.

As the air piston 11 and the liquid piston 21 move down, the air chamber Ra and the liquid chamber Rl are pressurized and pressurized air in the air chamber Ra flows through the air passage O, which is formed by the vertical grooves in the inner surface of the rod portion 15 of the air piston, the outer surface of the liquid piston, the horizontal grooves in the inner surface of the shoulder portion of the rod portion 15, and the upper end of the liquid piston 21, into the mixing chamber 26. On the other hand, pressurized foamable liquid A in the liquid chamber Rl flows through the liquid passage Cl in the liquid piston 21 into the mixing chamber 26, so that the air and the liquid are mixed with each other to produce foam.

Then, the foam thus produced leaves the mixing chamber 26 through the opening hole portion 17, and is homogenized into uniform and finer foam by passing through the net members 27 arranged in the foam passage Cf of the nozzle member 28 and dispensed from the opening at the tip of the nozzle member 28.

When the nozzle member 28 is released after it has been sufficiently depressed, the liquid piston 21 and integrally assembled air piston 11 instantly start moving UP together with the nozzle member 28 by the function of the coil spring 25. Soon thereafter, the funnel-shaped valve seat 24 of the liquid piston 21 comes into contact with the valve member portion 42 and urge the rod valve member 41 to move upwardly.

At this time, negative pressure prevails in the liquid chamber Rl and the air chamber Ra. As a result, the ball 9 of the first check valve 10 leaves the valve seat portion 7 to open the inlet of the liquid chamber Rl, and the outer thin annular valve portion 37 of the third check valve 34 is displaced inwardly to bring the outer annular rim portion 57 away from the annular projection on the inner surface of the upper wall disposed outwardly of the suction holes 45, thereby opening the suction holes 45. Simultaneously as the pressure in the air chamber Ra is released, on the other hand, the inner annular rim portion 58 of the inner thin annular valve portion 38 of the third check valve 34 is brought into contact with the upper surface of the annular projection 22 on the outer surface of the liquid piston 21, to close the inlet of the air passage O. As a result, the foamable liquid A in the dip tube 50 and the container 1 is sucked into the liquid chamber Rl, and the air in the upper space above the upper wall 14 of the air piston 11 is sucked into the air chamber Ra. Further, the foamable liquid A in the container is drawn into the dip tube 50, the air in the air cylinder 2 is sucked from the air hole 33 into the head space portion of the container 1, and the open air outside the container 1 is taken into the upper portion of the double cylinder C.

At this time, the inlet of the air passage O remains closed, as described above, so that foam in the mixing chamber 26 may not flow down the air passage O into the air chamber Ra.

The piston body P, the nozzle member 28 and the rod valve member 41 stop moving up any further at the top dead position shown in FIG. 1, and a desired amount of foam can be dispensed by repeating depression and release of the nozzle member 28.

Even if the container in FIG. 1 is inadvertently tipped over or fallen down, the liquid in the liquid passage Cl may not leak out of the container or go into the air chamber Ra through the mixing chamber 26, as the liquid outlet of the liquid passage Cl remains closed by the valve member portion 42 of the rod valve member 41 restricted of its upward movement by the cylindrical retaining member 39 and abuts on the valve seat 24 of the liquid piston 21 which is urged upwardly by the coil spring 25. Since the sliding seal portion 11P of the air piston 11 closes the air hole 33, no liquid in the container 1 may go out from the air hole 33 into the air chamber Ra or the air cylinder 2.

When the foam dispensing pump container 1 is in this state, moreover, the inner annular rim portion of the inner thin annular valve portion 38 of the elastic valve member 35 is in contact with the upper surface of the annular projection 22 of the liquid piston 21, and the cylindrical wall portion 36 of the elastic valve member 35 is in contact with the inner surface of the vertical wall 32 of the annular groove in the upper wall 14 to close the inlet of the air passage 0, so that any foam left or liquefied residual in the foam passage Cf and the mixing chamber 26, if flowing down through the air passage 0, will be prevented from going into the air chamber Ra by the cylindrical wall portion 36 and the inner thin annular valve portion 38 of the elastic valve member 35, the inner surface of the-upper wall 14 and the outer surface of the liquid piston 21. Moreover, a small amount of the foamable liquid A that may reside on the inner thin annular valve portion 38 or the annular projection 22 will be carried by pressurized air, at a subsequent operation of the nozzle member 28 into the mixing chamber 26, mixed with a far larger amount of the foamable liquid A pumped from the inside of the liquid chamber Rl, so that an air/liquid mixing ratio of the foam dispensed should not be adversely affected in substance.

Incidentally, the results of our experiments using the container of the first embodiment of the present invention have revealed that, for producing homogeneous fine foam from a foamable liquid having a viscosity of 10 centipoise or higher, it is preferable to set the distance between the two net members at 10 mm or more and to use the net member at the upstream side with a mesh (or pore) size of 0.1 $mm^2$ or less and the other net member with a mesh size of 0.015 $mm^2$ or less.

Figure 6:
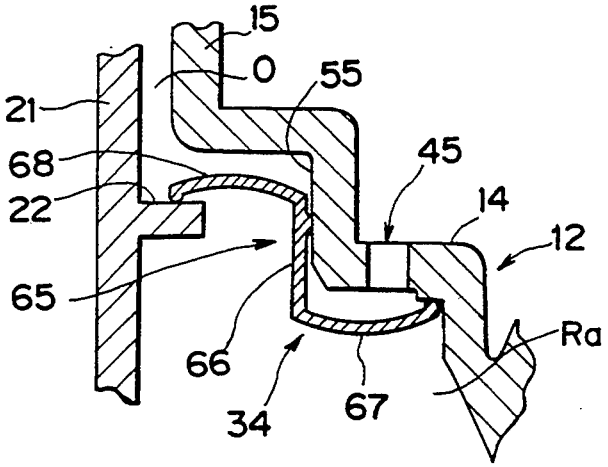
FIG. 6 is a longitudinal section showing a portion of a third check valve of the second embodiment of the present invention in an enlarged scale, in which the atmospheric pressure prevails in the air chamber.
Figure 7:
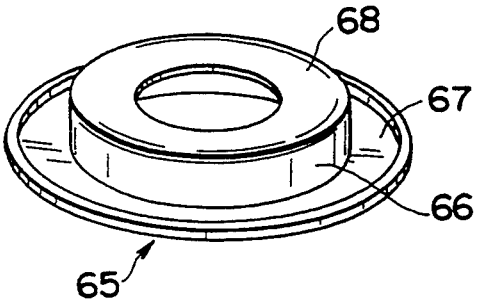
FIG. 7 is a perspective view showing the elastic valve member used in the second embodiment.

A second embodiment of the present invention will now be described with reference to FIG. 6 showing a longitudinal section and FIG. 7 showing a perspective view of an elastic valve member used in the second embodiment.

The second embodiment is different from the first embodiment in that the elastic valve member Constituting the third check valve 34 has the inner thin annular valve, portion extending from the upper end of the cylindrical wall portion, and that the vertical wall of the upper wall 14 contacting the cylindrical wall portion of the-elastic valve member does not form an annular groove. As all remaining constructions are common to those of the first embodiment, only the portions different from those of the first embodiment will be described.

An elastic valve member 65 of the second embodiment of the present invention is constructed, as is apparent from FIGS. 6 and 7, to include: a vertically extending cylindrical wall portion 66; an outer thin annular valve portion 67 extending outwardly from the lower end of the cylindrical wall portion 66 and having a generally convexed lower surface and a generally concaved upper surface and an inner thin annular valve portion 68 extending inwardly from the upper end of the cylindrical portion 66 and having a convexed upper surface and a generally concaved lower surface.

Constructed as aforementioned, the elastic valve member 65 of the second embodiment is advantageous over the elastic valve member 35 of the first embodiment in that flow of a soft synthetic resin in injection-molding operation to manufacture the elastic valve member is improved significantly.

The outer annular rim portion of the upper surface of the outer thin annular valve portion 67, the inner annular rim portion on the lower surface of the inner thin annular valve portion 68 and the upper surface of the cylindrical wall portion 66 are respectively provided with an annular projection for ensuring adequate contact respectively with the inner surface of the upper wall 14 and the upper surface of the annular projection 22.

The upper wall 14 of the air piston of the second embodiment has a portion formed into a vertical wall 55 which vertically extends from a portion slightly inward of the suction holes 45, and another portion formed into a horizontal wall which extends inwardly from the upper end of the vertical wall 55 and has its inner end connected to the rod portion 15.

In the second embodiment, as shown in FIG. 6, the elastic valve member 65 is so mounted in the air piston 11 that the annular projection on the outer surface of the cylindrical wall portion 66 and the inner surface of the vertical wall 55 of the upper wall 14 at the inner side of the suction holes 45 are in contact with each other, the upper surface of the outer annular rim portion of the outer thin annular valve portion 67 and the inner surface of the upper wall 14 extending outwardly beyond the suction holes 45 are in contact with each other, and the lower surface of the inner annular rim portion of the inner thin annular valve portion 68 and the upper surface of the annular projection 22 of the liquid piston 21 are in contact with each other.

The inner thin annular valve portion 68 and the inner surface of the upper wall 14 thereabove must be spaced from each other adequately enough so that the inner thin annular valve portion 68 may be displaced and moved away from the upper surface of the annular projection 22, and the vertical wall 55 of the upper wall 14 and the elastic valve member 65 need to be made to appropriate dimensions accordingly.

FIG. 6 shows the state of the elastic valve member when the nozzle member 28 is at its top dead position 12 as in FIG. 1 so that the suction holes 45 and the inlet of the air passage O are closed. When the nozzle member 28 is depressed and the piston body P is moved down, the second check valve 44 is opened in a manner similar to that of the first embodiment as the valve seat 24 of the liquid piston 21 is moved away from the valve member portion 42 of the rod valve member 41, but the first check valve 10 remains closed as the ball 9 is still seated on the valve seat portion 7.

At this time, the elastic valve member 65 of the third check valve 34 is urged towards the upper wall 14 by pressurized air so that the respective annular projections of the cylindrical wall portion 66 and the outer thin annular valve portion 67 are held in contact respectively with the inner surface of the vertical wall 55 and the upper wall 14 and thus the suction holes 45 remain closed. On the other hand, the inner thin annular valve portion 68 is displaced upwardly so that the annular projection formed on its outer annular rim portion is moves away from the upper surface of the annular projection 22 to open the inlet of the air passage O.

As the air piston 11 is moved down, the air chamber Ra is pressurized so that pressurized air therein spurts into the mixing chamber 26 through the air passage O.

As the liquid piston 21 goes down, at the same time, the liquid chamber Rl is pressurized so that pressurized foamable liquid A therein spurts into the mixing chamber 26 through the liquid passage Cl in the liquid-piston 21, and is mixed with the air in the mixing chamber 26 to produce foam. The foam thus produced leaves the mixing chamber 26 and is homogenized into uniform and finer foam by passing through the net members 27 arranged in the foam passage Cf and dispensed from the opening at the tip of the nozzle member 28.

Since the suction holes 45 of the present embodiment remain closed, before the piston body P is depressed or when the nozzle member 28 is in its top dead position, by the cylindrical wall portion 66 and the outer thin annular valve portion 67 of the elastic valve member 65 respectively in contact with the inner surfaces of the vertical wall 55 and the inner surface of the upper wall 14 disposed outwardly of the suction holes 45, the air pressurized in the air chamber Ra is delivered through the air passage O into the mixing chamber 26 without fail even if the piston body P is slowly depressed with a small amount of force. Therefore, the foam dispensing pump container of the present invention can also be used, as will be hereinafter described in reference to an embodiment, as a so-called finger type foam dispensing pump container which essentially is operated with a relatively small amount of force to actuate its pump relatively slowly by one's single hand holding a body of the container and depressing its nozzle member with a forefinger.

As soon as the nozzle member 28 is released from depressing force, the piston body P starts moving up by the function of the coil spring 25 and a negative pressure is created in the air chamber Ra so that the inner thin annular valve portion 68 of the elastic valve member 65, released from upward urging force of pressurized air, instantly restores its initial state, i.e. its lower inner annular rim portion comes in contact with the annular projection 22 again to close the inlet of the air passage O. When a negative pressure prevails in the air chamber Ra, the outer thin annular valve portion 67 of the elastic valve member 65 is drawn downwardly and away from the upper wall 14 so that it is displaced to bring its upper outer annular rim portion away from the inner surface of the upper wall 14 disposed outwardly of the suction holes 45 thereby opening the suction holes 45.

Immediately after the piston body P starts moving up, on the other hand, the valve seat 24 at the upper end of the liquid piston 21 comes into contact with the valve member portion 42 of the rod valve member 41 and closes the liquid outlet. Then the liquid piston 21 and the rod valve member 41 continue moving up together. As a result, a negative pressure is created in the liquid chamber Rl so that the ball 9 is urged to move up and away from the valve seat portion 7 by pressure of the foamable liquid A in the dip tube 50 to admit the foamable liquid A into the liquid chamber Rl (or the liquid cylinder 3).

While the piston body P is moving up, the air hole 33 formed in the air cylinder 2 stays open to admit the ,air in the upper portion of the air cylinder 2 into the head space portion of the container 1.

As the rod valve member 41 continues moving up, the diametrically enlarged portion 43 at its lower end portion abuts on and is engaged with the annular projection 40 of the cylindrical retaining member 39 so that the rod valve member 41 is restricted from further upward movement and the liquid piston 21 with its valve member portion 42 being in contact with the valve seat 24, and the air piston 11 stops moving.

At this time, the air chamber Ra is released from a negative pressure so that the upper outer annular rim portion of the outer thin annular valve portion 67 of the elastic valve member 65 comes into contact with the inner surface of the upper wall 14 disposed outwardly of the suction holes 45 to close the suction holes 45.

In this state, the nozzle member 28 and the piston body P are at their top dead positions respectively, as shown in FIG. 1, and the inlet of the air passage O is closed by the elastic valve member 65 so that the foam in the mixing chamber 26 may not flow into the air chamber Ra.

Figure 9:
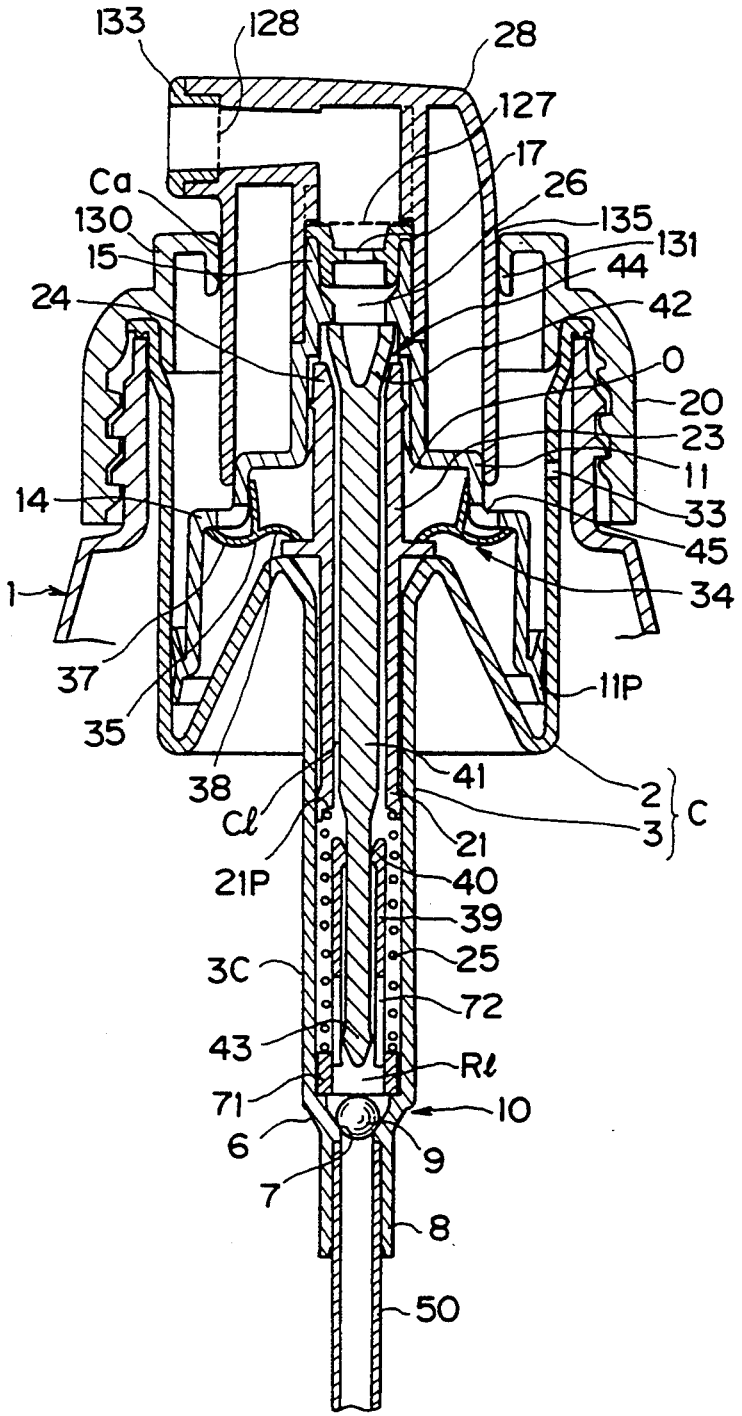
FIG. 9 is a longitudinal section showing an essential portion of the third embodiment in which the piston body is at the bottom dead position of its movement.

A third embodiment of the present invention will now be described with reference to FIGS. 8 and 9. FIG. 8 is a section showing an essential portion of the third embodiment in which the piston body is at its top dead position, and FIG. 9 is a section showing an essential portion of the same embodiment in which the piston body is at its bottom dead position. The third embodiment shown in FIGS. 8 and 9 is mainly different from the first embodiment in that the nozzle member 28 is not locked in its bottom dead position. More specifically, the third embodiment of the present invention has a lid member or a-lid means 20 made of a solid piece which replaces and includes portions corresponding to the lid member 18 and the collar 19, and there is no threaded portion in the lid means 20 for bringing the nozzle member 28 into threadable engagement when the nozzle member 28 is at its bottom dead position. The air piston 11 of the third embodiment does not have the annular seal portion 13 above the sliding seal portion 11P for closing the air hole 33 of the air cylinder 2. Also, the third embodiment has an over cap 120 to be fixed on the lid means 20. In addition to these, according to the third embodiment, a net member 128 is mounted in a nozzle portion at a downstream end of the foam passage Cf of the nozzle member 28. The remaining construction of the third embodiment is substantially identical to that of the first embodiment with exceptions of minor changes that are negligible for purposes of disclosure herein, and therefore descriptions of the portions of the third embodiment which are identical or similar to those of the first embodiment have been omitted and such portions have been denoted in FIGS. 8 simply by reference numbers of corresponding portions of the first embodiment.

As shown in FIG. 8, the rod valve member 41 disposed in the liquid cylinder 3 and the liquid piston 21 is retained, at its diametrically enlarged lower portion 43, by the annular projection 40 of the cylindrical retaining member 39 so that it is restricted from moving up. In this state the valve seat 24 at the upper end of the liquid piston 21 is in contact with the valve member portion 42 at the upper end of the rod valve member 41 so that the liquid piston is restricted from moving upwards. In other words, the piston body P and the nozzle member 28 are at their respective top dead positions in FIG. 8. When the piston body P is in this position, the valve seat 24 of the liquid piston 21 and the valve member portion 42 of the rod valve member 41 are in contact with each other, closing the liquid passage Cl. At the same time, the sliding seal portion 11P of the C-shaped section of the air piston 11 is at a position to close the air hole 33 of the air cylinder 2.

The over cap 120 fixed on the lid means 20 accommodates the nozzle member completely, as shown, when the piston body P is at its top dead position to prevent the nozzle member 28 from being moved down undesirably, during transportation, by contact with another container 1, a shipping carton accommodating the containers 1 or by one's hands.

Therefore, the foam dispensing pump container 1 of the third embodiment of the present invention can be filled with a foamable liquid A and shipped from the factory, in the state as shown in FIG. 8, and the foamable liquid A in the container 1 is effectively prevented from being dispensed undesirably from the opening at the tip of the nozzle member 28, or from going through the air hole 33 into the air cylinder 2 while the container 1 is being transported or displayed on a shelf at a retailer's shop. Incidentally, if the over cap 120 comes off the lid means 20, the nozzle member 28 may be depressed unintentionally by impact of another container or a carton and foam of the foamable liquid A may be dispensed undesirably. In this third embodiment, therefore, the over cap 120 has a small annular projection on its inner bottom rim portion, and an outer vertical wall 130 at the upper end of the lid means 20 is tapered downwardly to reduce its diameter so that once fitted to the lid means 20 the over cap 120 may not readily come off the lid means 20.

Of course, the entire foam dispensing pump container including the over cap 120 and the lid means 20 may preferably be wrapped with a thermally shrinking film so as to hold the over cap in position more positively.

The nozzle member 28 has a relatively short nose and a ring like insert 133 fixed to the opening of the tip of the nose. The insert 133 has an outwardly extending flange portion on one side and a net member 128 welded to the other side thereof.

Further, the nozzle member 28 has a cylindrical portion 135 depending from the top portion thereof and having a lower end portion in contact with the outer circumference of the upper portion of the air chamber 12 of the air piston 11. The cylindrical portion 135 is sized to establish only a small gap between itself and an inner vertical wall 131 which is formed internally of the outer vertical wall 130 of the lid means 20.

The reason for providing this small gap is such that if the gap is too large, foam of the foamable liquid A caught at the opening at the tip of the nose of the nozzle member 28 may fall onto the lid means 20 and the foam or its liquefied residue may flow through that gap into air cylinder 2. If the gap does not exist, on the contrary, the open air cannot be taken into the space of the air cylinder above the air piston 11 when the piston body P is depressed.

The air taken into the space of the air cylinder 2 above the air piston 11 while the piston body P is being depressed is introduced, when the piston body P moves up, into the space of the air cylinder below the air piston 22 through the suction holes 45 which are opened by the elastic deformation of the outer thin annular valve portion 37 of the elastic valve member 35 of the third check valve 34.

In order to completely prevent the residual foam from flowing into the air cylinder 2, the gap between the outer surface of the cylindrical wall portion 135 of the nozzle member 28 and the inner surface of the inner vertical wall portion 131 of the lid means 20 may be eliminated and replaced by a gap to be provided between the inner surface of the cylindrical wall portion 135 and the outer circumference at the upper end of the air chamber portion 12 of the air piston 11 and an air intake hole to be provided in the cylindrical wall portion 135 or in a portion of the top wall of the nozzle member 28 between the cylindrical wall portion 135 and the stem 29.

In this embodiment, there is arranged downstream of the mixing chamber 26 a cylindrical member 132 having a flange on one end and a net member 127 welded to the flange portion. This cylindrical member 132 is fitted in the upper end of the rod portion 15 of the air piston 11. In this arrangement, the two net members 127 and 128 are disposed at a distance from one to the other greater than the distance between the two net members 27 of the first embodiment in which the net members are welded to the respective sides of the single spacer.

In this embodiment, as is apparent from FIGS. 8 and 9, the annular seal member 73 installed between the opening portion of the container 1 and the double cylinder C of the first embodiment has been eliminated and the valve member portion 42 of the rod valve member 41 is made hollow to prevent its possible distortion when formed by injection-molding.

Operation of the foam dispensing pump container of this embodiment by depressing and releasing the nozzle member 28, and actions of the piston body P, the first check valve 10, the second check valve 44 and the third check valve 34 are identical to those of the first embodiment, and relevant descriptions have been omitted.

Incidentally, the over cap 120 should of course be removed from the lid means 20 in advance of operation of the foam dispensing pump container of the third embodiment, and refitted to the lid means 20 at completion of the operation.

Thus, even if the container 1 is inadvertently fallen down from a shelf or the like, neither foam nor the liquid should spurt out of the nozzle member 28, and residual foam in the foam passage Cf may not get dry or solidified at the net members 127 to clog their meshes unless the over cap 120 comes off the lid means 20.

Although the individual portions of the foam dispensing pump container have been considerably enlarged for purposes of illustration in FIGS. 8 and 9, the nozzle member 28 having a relatively short nose as in this embodiment is generally suitable for a relatively small container, and accordingly the foam dispensing pump container of this embodiment is preferably used as a so-called finger-type foam dispensing pump container which is operated by one's single hand holding a body of the container and depressing the top portion of the nozzle member 28 with its forefinger to dispense foam of a foamable liquid.

The elastic valve member 35 used in the present invention can readily be manufactured as an integral component by an injection-molding method or the like and since its individual portions are of thin plate like construction, its manufacture is not costly.

Moreover, the inner thin annular valve portion 38, the cylindrical wall portion 36 and the outer thin annular valve portion 37 of circular shapes eliminate adjustment of the elastic valve member with respect to the position of the suction holes 45, so that the pump assembling operation is simplified and facilitated.

In the embodiments thus far described, the sheet-like porous members have been fabricated by the nets of a synthetic resin but the porous members may be fabricated by other materials such as metal nets, synthetic resin or metal panels having a multiplicity of fine pores, and the mixing chamber 26 which have been formed in the upper portion of the rod portion 15 of the air piston 11 may be provided in the stem 29 of the nozzle member 28.

In the foregoing embodiments, the elastic valve member has its outer thin annular valve portion and inner thin annular valve portion provided with convexed surfaces on one side and concaved surfaces on the other with a view to improving their strength and preventing their deformation, but those surfaces may not necessarily be convexed or concaved. Also, the annular projections have been formed on the upper surface of the outer annular rim portion of the outer thin annular valve portion and the lower surface of the inner annular rim portion of the inner thin annular valve portion in the foregoing embodiments so as to improve the sealing contact with the valve seats, but those annular projections may be eliminated, so far as satisfactory valve operations of the elastic valve member are ensured.

Further, in the foregoing embodiments, the inner surface of the upper wall which comes in contact with the cylindrical portion of the elastic valve member has been formed in the vertical wall but can be provided in the upper surface of the annular groove. Still further, a cylindrical dependant wall depending from the inner surface of the upper wall may be formed in a Close vicinity of the inner surface of the vertical wall, so that the upper end of the cylindrical wall portion of the elastic valve member may be clamped and held by the vertical wall and the cylindrical dependant wall.

Also, the two suction holes which have been provided in the foregoing embodiments may be replaced by a single hole or more than two holes depending upon a size of such holes. It should be noted that if the outer thin annular valve portion is flat and becomes gradually thinner towards its outer annular rim portion, only the outer annular rim portion tends to be displaced when the outer thin annular valve portion is urged downward, and therefore, it is recommendable to elongate the suction holes circumferentially or to increase the number of suction holes when the elastic valve member with such flat and gradually thinned outer thin annular valve portion is used.

Further, the portions that come in contact respectively with the outer annular rim portion of the outer thin annular valve portion and the inner annular rim portion of the inner thin annular valve portion may not necessarily have flat and horizontal surfaces, but may be curved or tapered, for example.

Still further, in the foregoing embodiments, the first check valve has the ball member and the second check valve has the rod valve member. However, both of these valves may have ball members or other appropriate valve members.

The foam dispensing foam container according to the present invention has several advantages.

In the foam dispensing pump container according to the present invention, the suction holes formed in the upper wall of the air piston and the inlet of the air passage provided for communication between the air chamber and the air passage are so effectively controlled by the elastic valve member mounted in the air piston that the suction holes may open only when a negative pressure prevails in the air chamber whereas the inlet of the air passage may open only when a positive pressure prevails in the air chamber and both the suction holes and the inlet of the air passage are otherwise closed at all times. Owing to these arrangements, the pressurized air in the air chamber may not leak through the suction holes and is fed through the air passage to the mixing chamber no matter whether the nozzle member or the piston body is depressed vigorously or slowly with a small amount of force for dispensing foam of a foamable liquid, so that the pressurized air fed from the air chamber is mixed with the foamable liquid fed from the liquid chamber to produce foam of the foamable liquid prepared at a predetermined air/liquid mixing ratio at all times, and the foam thus prepared is fed through the foam passage and dispensed out of the opening of the nozzle member.

With the foam dispensing pump container of the present invention constructed as above, the inlet of the air passage is closed as soon as the nozzle member is released from the depressing force and the suction holes open as the piston body goes up and a negative pressure is created in the air chamber so that foam of the foamable liquid in the foam passage and in the mixing chamber may not flow down into the air chamber.

Even when the nozzle member of the foam dispensing pump container of the present invention, as described above, is operated slowly, the pressurized air fed from the air., chamber goes into the mixing chamber without fail, and is mixed with the foamable liquid in the mixing chamber to produce foam, which is dispensed from the opening of the nozzle member. In addition, as soon as the air chamber is released from a pressurized state or the nozzle member is released from depressing force, the inlet of the air passage is closed to prevent the foam in the mixing chamber from entering into the air chamber. Therefore, neither the foamable liquid nor the foam may go into or reside in the air chamber even if the nozzle member is operated slowly for numbers of times. Thus, the foam dispensing pump container according to the present invention has successfully eliminated such disadvantages of the prior art foam dispensing pump containers, in which the suction hole is opened and closed by the ball valve, that foam having a higher liquid ratio than a predetermined air/liquid mixing ratio or unfoamed foamable liquid is dispensed from the nozzle member.

What is claimed is:

1. A foam dispensing pump container comprising: a lid means; a double cylinder which is fastened to the container by the lid means mounted on an opening portion of said container and which comprises an air cylinder and a liquid cylinder which is smaller in diameter than said air cylinder, both arranged concentrically; an air piston accommodated in said air cylinder for reciprocal movements in an axial direction of said air cylinder and urged upwardly by a spring means, an air chamber formed below said air piston in said air cylinder; a liquid piston accommodated in said liquid cylinder for reciprocal movements in an axial direction of said liquid cylinder and urged upwardly by said spring means, said liquid piston forming, in conjunction with said air piston, an integral piston body having a hollow rod portion extending upwardly through an opening of said lid means; a liquid chamber formed below said liquid piston in said liquid cylinder; an air passage formed in a space defined by inner surfaces of an upper portion of said air piston and outer surfaces of said liquid piston; a liquid passage formed in said liquid piston, a mixing chamber formed above and communicating with both said air chamber and said liquid chamber through said air passage and said liquid passage respectively; a hollow bent nozzle member having a nose portion and a stem portion and mounted at its stem portion to an upper end of said piston body; a foam passage formed through said nozzle member and communicating with said mixing chamber; at least one porous member disposed across said foam passage; a first check valve disposed in a lower end portion of said liquid chamber and adapted to be opened when a negative pressure is created in said liquid chamber; a dip tube attached to a lower end of said liquid cylinder below said first check valve and extending to a bottom portion of said container; a second check valve at least partially disposed in an upper end of said liquid passage for opening an outlet of said liquid passage to said mixing chamber when said liquid chamber is pressurized; an air hole disposed in said air cylinder for introducing external air into a head space created in said container when said container is filled to a fill level; at least one suction hole provided in an upper wall of said air piston; and a third check valve disposed to be adapted to open and close said at least one suction hole for introducing air into said air chamber when a negative pressure is created in said air chamber, wherein said third check valve includes an elastic valve member, comprising a cylindrical wall portion, an outer thin annular valve portion extending outwardly from said cylindrical wall portion and an inner thin annular valve portion extending inwardly from said cylindrical wall portion, and being held at an inner surface of said upper wall of said air piston, said cylindrical wall portion at least partially contacting a first portion of said inner surface of said upper wall extending between said suction hole and said air passage, said outer thin annular valve portion contacting, at an outer annular rim portion, a second portion of said inner surface of said upper wall extending outwardly beyond said suction hole, and said inner thin annular valve portion contacting, at an inner annular rim portion, an annular projection which is formed below said air passage and on an outer surface of said liquid piston.

2. A foam dispensing pump container according to claim 1, wherein the first portion of the inner surface of the upper wall of said air piston which comes in contact with the cylindrical wall portion of said elastic valve member is vertically disposed.

3. A foam dispensing pump container according to claim 1, wherein the outer thin annular valve portion of said elastic valve member has a generally concaved upper surface and a generally convexed lower surface, and the inner thin annular valve portion of said elastic valve member has a generally convexed upper surface and a generally concaved lower surface.

4. A foam dispensing pump container according to claim 2, wherein the outer thin annular valve portion of said elastic valve member has a generally concaved upper surface and a generally convexed lower surface, and the inner thin annular valve portion of said elastic valve member has a generally convexed upper surface and a generally concaved lower surface.

5. A foam dispensing pump container according to claim 1, wherein the piston body moves vertically and the second check valve comprises:

a rod valve member disposed in said liquid passage and adapted to be forcibly moved up and down by a given amount in accordance with the vertical movements of said piston body; and a cylindrical retaining member having an upper cylindrical portion fitted snugly in said liquid passage and disposed in said liquid chamber for engaging at its inner surfaces with, and restricting vertical movements of said rod valve member such that the outlet of said liquid passage to said mixing chamber is closed by an upper portion of said rod valve member while said piston body is moving up and said rod valve member is held engaged at a lower portion with said cylindrical retaining portion and prevented from moving upwards while said outlet of said liquid passage remains closed when said piston body is at a top dead position of its reciprocal movement, but said liquid passage and the outlet of said liquid passage to said mixing chamber are opened as said piston body moves down, and when said piston body is at a bottom dead position of its reciprocal movements and said nozzle member is in engagement with said lid means, said liquid passage is closed by said rod valve member and said rod valve member is snugly fitted in the upper cylindrical portion of said cylindrical retaining member which is snugly fitted into a portion of said liquid piston forming said liquid passage, and prevented from moving down.

6. A foam dispensing pump container according to claim 2, wherein the piston body moves vertically and the second check valve comprises:

a rod valve member disposed in said liquid passage and adapted to be forcibly moved up and down by a given amount in accordance with the vertical movements of said piston body; and a cylindrical retaining member having an upper cylindrical portion fitted snugly in said liquid passage and disposed in said liquid chamber for engaging at its inner surfaces with, and restricting vertical movements of said rod valve member such that the outlet of said liquid passage to said mixing chamber is closed by an upper portion of said rod valve member while said piston body is moving up and said rod valve member is held engaged at a lower portion with said cylindrical retaining portion and prevented from moving upwards while said outlet of said liquid passage remains closed when said piston body is at a top dead position of its reciprocal movement, but said liquid passage and the outlet of said liquid passage to said mixing chamber are opened as said piston body moves down, and when said piston body is at a bottom dead position of its reciprocal movements and said nozzle member is in engagement with said lid means, said liquid passage is closed by said rod valve member and said rod valve member is snugly fitted in the upper cylindrical portion of said cylindrical retaining member which is snugly fitted into a portion of said liquid piston forming said liquid passage, and prevented from moving down.

7. A foam dispensing pump container according to claim 3, wherein the piston body moves vertically and the second check valve comprises:

a rod valve member disposed in said liquid passage and adapted to be forcibly moved up and down by a given amount in accordance with the vertical movements of said piston body; and a cylindrical retaining member having an upper cylindrical portion fitted snugly in said liquid passage and disposed in said liquid chamber for engaging at its inner surfaces with, and restricting vertical movements of said rod valve member such that the outlet of said liquid passage to said mixing chamber is closed by an upper portion of said rod valve member while said piston body is moving up and said rod valve member is held engaged at a lower portion with said cylindrical retaining portion and prevented from moving upwards while said outlet of said liquid passage remains closed when said piston body is at a top dead position of its reciprocal movement, but said liquid passage and the outlet of said liquid passage to said mixing chamber are opened as said piston body moves down, and when said piston body is at a bottom dead position of its reciprocal movements and said nozzle member is in engagement with said lid means, said liquid passage is closed by said rod valve member and said rod valve member is snugly fitted in the upper cylindrical portion of said cylindrical retaining member which is snugly fitted into a portion of said liquid piston forming said liquid passage, and prevented from moving down.

8. A foam dispensing pump container according to claim 1, further comprising:

a sliding seal portion formed on an outer circumferential portion of said air piston and adapted to move up and down in close sealing contact with inner wall surfaces of said air cylinder in accordance with the reciprocal movements of said piston body, said sliding seal portion being sized and shaped to close said air hole formed in said air cylinder, when said piston body is at a top dead position of its reciprocal movements.

9. A foam dispensing pump container according to claim 2, further comprising:

a sliding seal portion formed on an outer circumferential portion of said air piston and adapted to move up and down in close sealing contact with inner wall surfaces of said air cylinder in accordance with the reciprocal movements of said piston body, said sliding seal portion being sized and shaped to close said air hole formed in said air cylinder, when said piston body is at a top dead position of its reciprocal movements.

10. A foam dispensing pump container according to claim 3, further comprising:

a sliding seal portion formed on an outer circumferential portion of said air piston and adapted to move up and down in close sealing contact with inner wall surfaces of said air cylinder in accordance with the reciprocal movements of said piston body, said sliding seal portion being sized and shaped to close said air hole formed in said air cylinder, when said piston body is at a top dead position of its reciprocal movements.

11. A foam dispensing pump container according to claim 4, further comprising:

a sliding seal portion formed on an outer circumferential portion of said air piston and adapted to move up and down in close sealing contact with inner wall surfaces of said air cylinder in accordance with the reciprocal movements of said piston body, said sliding seal portion being sized and shaped to close said air hole formed in said air cylinder, when said piston body is at a top dead position of its reciprocal movements.

12. A foam dispensing pump container according to claim 8, further comprising:

an annular seal portion formed on a portion of said outer circumferential portion of said air piston above and at a predetermined distance from, said sliding seal portion and sized and shaped to close said air hole of said air cylinder; and an air passage forming portion disposed in an upper wall portion of said air cylinder for forming an air passage between itself and said annular seal portion on said air piston for allowing air to pass therethrough when said piston body is within a predetermined range between the top dead position and a bottom dead position, both arranged such that said sliding seal portion of said air piston closes said air hole when said piston body is at its top dead position and said annular seal portion of said air piston closes said air hole when said piston body is at its bottom dead position and said nozzle member is in engagement with said lid means.

13. A foam dispensing pump container according to claim 9, further comprising:

an annular seal portion formed on a portion of said outer circumferential portion of said air piston above and at a predetermined distance from, said sliding seal portion and sized and shaped to close said air hole of said air cylinder; and an air passage forming portion disposed in an upper wall portion of said air cylinder for forming an air passage between itself and said annular seal portion on said air piston for allowing air to pass therethrough when said piston body is within a predetermined range between the top dead position and a bottom dead position, both arranged such that said sliding seal portion of said air piston closes said air hole when said piston body is at its top dead position and said annular seal portion of said air piston closes said air hole when said piston body is at its bottom dead position and said nozzle member is in engagement with said lid means.

14. A foam dispensing pump container according to claim 10, further comprising:

an annular seal portion formed on a portion of said outer circumferential portion of said air piston above and at a predetermined distance from, said sliding seal portion and sized and shaped to close said air hole of said air cylinder; and an air passage forming portion disposed in an upper wall portion of said air cylinder for forming an air passage between itself and said annular seal portion on said air piston for allowing air to pass therethrough when said piston body is within a predetermined range between the top dead position and a bottom dead position, both arranged such that said sliding seal portion of said air piston closes said air hole when said piston body is at its top dead position and said annular seal portion of said air piston closes said air hole when said piston body is at its bottom dead position and said nozzle member is in engagement with said lid means.

15. A foam dispensing pump container according to claim 11, further comprising:

an annular seal portion formed on a portion of said outer circumferential portion of said air piston above and at a predetermined distance from, said sliding seal portion and sized and shaped to close said air hole of said air cylinder; and an air passage forming portion disposed in an upper wall portion of said air cylinder for forming an air passage between itself and said annular seal portion on said air piston for allowing air to pass therethrough when said piston body is within a predetermined range between the top dead position and a bottom dead position, both arranged such that said sliding seal portion of said air piston closes said air hole when said piston body is at its top dead position and said annular seal portion of said air piston closes said air hole when said piston body is at its bottom dead position and said nozzle member is in engagement with said lid means.

* * * * *